United States Patent [19]

Donnet

[11] 4,018,028

[45] Apr. 19, 1977

[54] ARRANGEMENT FOR ALIGNING HEAT-SEALABLE LIDS ON MATING PRODUCT-FILLED CONTAINERS

[75] Inventor: Henry Donnet, Falaise, France

[73] Assignee: Societe d'Application Plastique Mecanique et Electronique, Plastimecanique S.A., Courbevoie, France

[22] Filed: Oct. 23, 1975

[21] Appl. No.: 625,325

Related U.S. Application Data

[63] Continuation-in-part of Ser. No. 273,273, July 19, 1972, abandoned.

[30] Foreign Application Priority Data

July 23, 1971 France ..... 71.27006

[52] U.S. Cl. ..... 53/51; 53/184 R

[51] Int. Cl.² ..... B65B 9/04

[58] Field of Search ..... 53/3, 14, 51, 30 R, 53/184 R, 282

[56] References Cited

UNITED STATES PATENTS

| | | | |
|---|---|---|---|
| 3,267,639 | 8/1966 | Ollier et al. | 53/51 |
| 3,294,301 | 12/1966 | Richter | 53/51 X |
| 3,374,602 | 3/1968 | Hamilton | 53/51 |
| 3,555,768 | 1/1971 | Miller | 53/51 X |
| 3,762,125 | 10/1973 | Prena | 53/51 |

*Primary Examiner*—Travis S. McGehee
*Assistant Examiner*—J. Sipos

[57] ABSTRACT

An arrangement is described for registering stretchable lids with mating product-filled troughs of a heat-sealed product container prior to the heat-sealing operation. The troughs are preformed at first intervals on a first strip, which is successively indexed through the first interval into the heat-sealing station. The lids are defined between regularly spaced detectable markings on a second strip, which is moved into the heat-sealing station simultaneously with the first strip. The markings on the second strip are normally spaced by a second interval slightly smaller than the first interval. At the end of each indexing movement, a marking on the second strip comes into alignment with a photocell to generate a signal. A stretching station upstream of the photocell responds to the signal to grip a lid-defining section of the second strip between spaced clamps, and to thereafter impart a permanent elongation to the gripped lid by an amount sufficient so that the elongated section later registers with a trough at the heat-sealing station.

3 Claims, 3 Drawing Figures

ARRANGEMENT FOR ALIGNING HEAT-SEALABLE LIDS ON MATING PRODUCT-FILLED CONTAINERS

CROSS-REFERENCE TO RELATED APPLICATION

This is a continuation-in-part of applicant's copending, coassigned application Ser. No. 273,273 filed July 19, 1972 and entitled "Improvements In Apparatus For Forming Containers Closed With A Labeled Cover" now abandoned.

BACKGROUND OF THE INVENTION

The invention relates to techniques for forming heat-sealed product containers, and more particularly to techniques for registering heat-sealable, stretchable lids with mating product-filled containers prior to the heat-sealing operation.

In known arrangements of this type described, e.g., in U.S. Pat. No. 3,267,639, issued to J. G. H. OLLIER ET AL on Aug. 23, 1966, a first ductile strip carrying a plurality of product-receiving troughs preformed therein is incrementally advanced through equal first intervals into a heat-sealing station. The lids for the troughs are simultaneously advanced into the heat-sealing station, the lids being defined by spaced portions of a second ductile strip between detectable markings located at equal intervals along the second strip. The troughs are disposed at a center distance equal to the first interval, while the detectable markings on the second strip are normally spaced at second intervals which are slightly smaller than the first intervals of the troughs on the first strip.

In such known arrangement, the advancing means are disposed downstream of the heat-sealing station and positively grips the front ends of both the first and second strips. As soon as the advancing means has indexed both of such strips through the second interval, a mark on the second strip comes into registration with a photocell, which generates a signal that effects the clamping of one portion of the second strip at a single point upstream of the photocell. Since the advancing means continues to move until the entire first indexing interval has been traversed, and since the front ends of the first and second strips are firmly attached to the advancing means, the entire portion of the second strip between the clamp point behind the photocell and the gripped front end will be temporarily stretched by an amount adjusted to assure that the distance between successive markings on the portion of the second disposed at the heat-sealing station corresponds to the first interval. As a result, such portion of the second strip is registerable with the trough then entering the heat-sealing station to assure proper alignment of the container parts prior to the heat-sealing operation proper.

This arrangement has several disadvantages. For example, since the advancing means must provide the full stretching force on the second strip, such advancing means must be of rugged and expensive fabrication or else it will not provide the required elongation of the second strip by the time the advancing means comes to rest, thereby leading to registration errors at the heat-sealing station.

Moreover, since the advancing means in such apparatus is located downstream of the heat-sealing station, a portion of the first and second strips simultaneously indexed by the advancing means are already welded together behind the advancing means. The unavoidable initial fractures occurring at the welding points therefore subjects the later-stretched second strip to the risk of tearing and other defects, particularly in view of the typically long length of stretched second strip between the advancing means and the single clamping point upstream of the photocell.

SUMMARY OF THE INVENTION

These problems are overcome with the use of the arrangement in accordance with the invention for registering the lid sections of the second strip with the trough sections on the first strip entering the heat-sealing station. In an illustrative embodiment, the stretching facilities for the second strip are disposed upstream of the photocell and include a pair of clamps which are spaced apart by the second interval and which are actuable to grip a discrete section of the moving second strip upon the occurrence of the first signal from the detector. Upon actuation of the clamps, a ram-type punch disposed intermediate the clamps is operated to impart a permanent elongation of the gripped section of the second strip by an amount equal to the difference between the first and second intervals.

Facilities are provided for relatively adjusting the axial position of the photocell and the second strip so that at the conclusion of each indexing movement of the first and second strips through the first interval, a marking on the second strip comes into registration with the photocell to generate the signal and thereupon actuate the spaced clamps and the intermediate ram.

Because of the "slack" present in the stretching station after the ram has elongated the gripped portion of the second strip, the indexing movement of the portion of the second strip on the downstream side of the stretching facilities will be accompanied by a movement of the second strip through the smaller second interval on the upstream side of the stretching facilities. As a result, once the photocell is correctly positioned to register with a mark on the second strip at the conclusion of the indexing interval, each successive mark on the stretched portion of the second strip will automatically be located to effect the same alignment with the photocell at the corresponding time.

Such improved arrangement is highly advantageous since the entire stretching operation is completed while the second strip is stationary and prior to the time that the first and second strips enter the heat-sealing station. Since the advancing means plays no part in the stretching operation, it can be much more inexpensively built than the rugged versions of the prior art which were necessary to effect both the indexing and stretching operations. Moreover, since the same amount of elongation is automatically imparted to each successive section of the second strips between the spaced markings thereon, registration errors at the heat-sealing station between the lids and the product-filled troughs are effectively avoided.

Additionally, since the stretching operation can be extended over the entire, relatively long stationary portion of the indexing cycle rather than compressed into the end of the moving portion of such cycle as in the prior art, ample time is available to permit a simple and precise stretching of the second strip with relatively light-duty equipment. Also, the fact that such stretching operation takes place over a relatively short length of the second strip (i.e., one second interval) rather than over a relatively long portion extending from a gripping area upstream of the detector to a point downstream of the heat-sealing station, increases the accuracy and repeatability of the elongation.

BRIEF DESCRIPTION OF THE DRAWING

The invention is further set forth in the following detailed description taken in conjunction with the appended drawing, in which.

DETAILED DESCRIPTION

Figure 1:
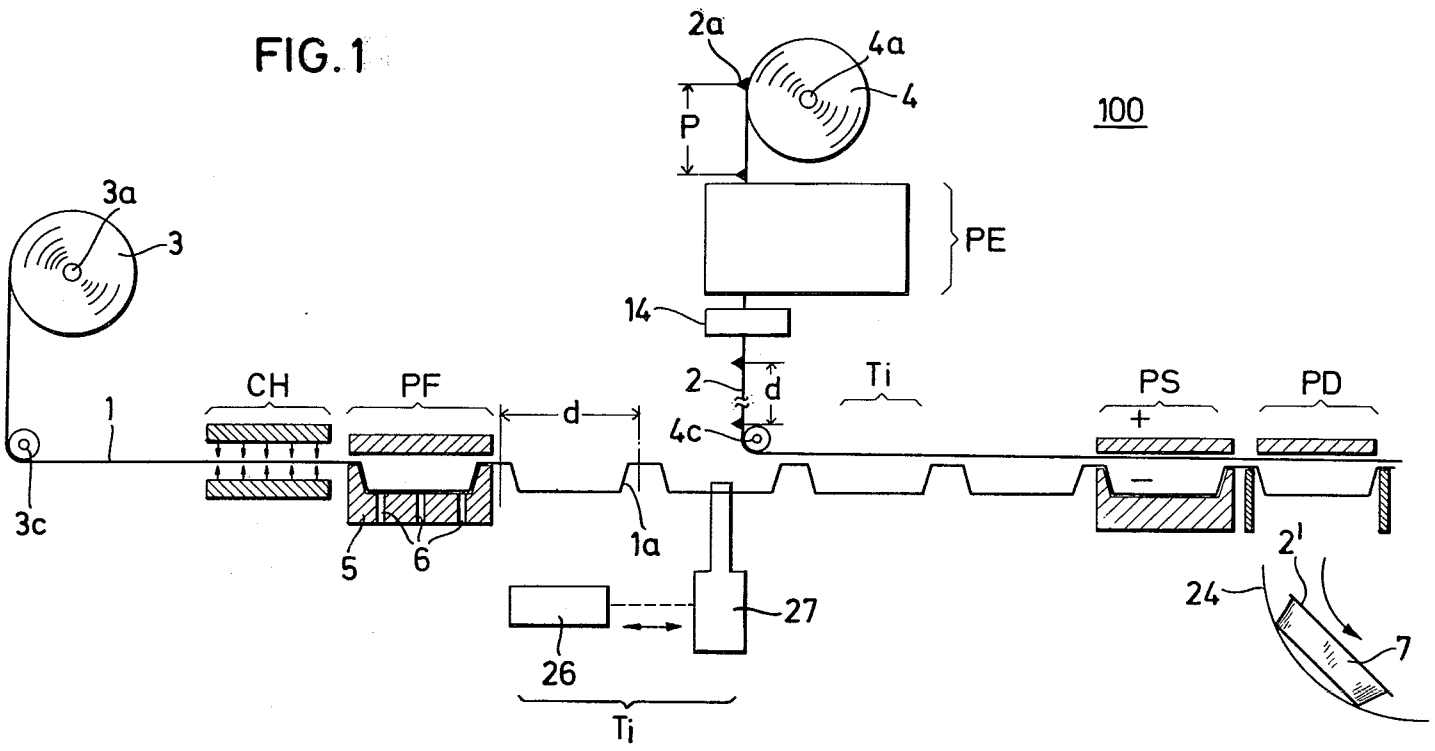
FIG. 1 is a representation of an overall arrangement for heat-sealing stretchable lids to a plurality of product-filled troughs, including stretching and lid registration facilities in accordance with the invention.

Referring now to the drawing, a production facility 100 for manufacturing a plurality of heat-sealed plastic containers 7, 7 from a pair of ductile strips 1 and 2 is shown.

A succession of troughs 1*a* 1*a* are preformed on the strip 1 at equal intervals *d*, and the successive troughs 1*a* are individually brought into registration with lid-forming portions 2', 2' of the strip 2 to be heat-sealed therewith. Each of the lid sections is defined between a pair of detectable markings 2*a*, 2*a*, which for proper registration with the associated troughs 1*a* should be separated by the distance *d* immediately prior to the heat-sealing operation. If desired, each of the lid sections defined between the markings 2*a* may be provided with an embossed or glued-on label (not shown) for identification of the final container 7.

In the embodiment shown in FIG. 1, the strip 1 is formed from an extensible plastic material such as polyvinylchloride, polystyrene or low-density polyethylene, and is initially wound around a reel 3 supported on a shaft 3*a*. The strip 2 is also formed from a similar thermoplastic material or from a ductile metal such as aluminum, and is initially wound around a reel 4 supported on a shaft 4*a*.

Since it is advantageous to initially stretch each lid of the containers 7 over the associated trough 1*a* prior to the heat-sealing operation in order to improve the seal, and since proper registration between the lids and the troughs require that the distance between the lid sections, and thereby between the detectable markings 2*a* on the strip 2 correspond to the pitch distance *d* between the troughs 1*a*, the unstretched distance between successive markings 2*a* must be slightly less than the final distance *d* at the heat-sealing station. Such initially unstretched distance between the successive markings 2*a* is represented by the letter P in FIG. 1. Accordingly, it is customary to provide facilities for stretching the successive lid portions of the strip 2 entering the heat-sealing station from their initial length P to the length *d;* and an improved technique for providing such stretching is described in more detail below.

At this point, the general manner in which the arrangement so far described in FIG. 1 operates to form the successive heat-sealed containers 7 is as follows. The first strip 1 is unwound from the reel 3, routed around a guide roller 3*a* and through a heating device CH. The device CH is provided with suitable facilities for softening the strip 1. From the heating device CH, the first strip 1 is advanced to a molding device PF. The device PF has a lower mold portion 5 whose shape corresponds to the base and side walls of the troughs 1*a*, and is provided with a plurality of apertures 6, 6 for subjecting the interior of the mold portion 5 to a partial vacuum. As a result of such partial vacuum, the preheated section of the strip 1 within the mold portion 5 is deformed into the shape of the trough 1*a*. The length of the mold section 5 and the rate of advance of the strip 1 through the section PF is suitably designed to define the above-mentioned center distance *d* between the successive troughs.

From the section PF, the preformed troughs 1*a* are suitably filled with a product in a manner not shown, and are then advanced, together with a front section of the strip 2, into a heat sealing station PS. For this purpose, the strip 2 is suitably unwound from the reel 4 and is routed around a guide roller 4*c* into superimposed relation with the advancing troughs 1*a*. The length of the heat-sealing station PS is illustratively designed to accommodate one section, of length *d*, of the trough 1*a* and a correspondingly registered stretched lid section of the strip 2, also having a length equal to the distance *d* as indicated above.

During a stationary portion of the cycle of advance of the strips 1 and 2, the heat-sealing PS welds the stretched lid section therein to the underlying trough 1*a*, after which the just-welded container 7 is severed from the remainder of the strips 1 and 2 in a cutting and ejecting device PD. The severed container 7 is guided to suitable utilization facilities via a chute 24.

Each of the successive preformed troughs 1*a* is indexed into the heat-sealing station PS through a distance equal to the trough center distance *d* by means of an advancing mechanism consisting of a piston-type pneumatic ram 26 mechanically coupled to a bracket 27 adapted to grip the successive troughs 1*a*. The bracket 27 is arranged for cyclic movement back and forth along the axis of advance of the strip 1 through the distance *d*. For reasons indicated below, the advancing mechanism is disposed upstream of the heat-sealing station PS and, in the arrangement depicted in FIG. 1, out of direct contact with the strip 2. Nevertheless, the indexing movement of the bracket 27 on the successive troughs 1*a* is effective to simultaneously advance the strip 2 from the reel 4 and into the welding station PS, since the front ends of the strip 1 and 2 are joined together by the welding operation.

In accordance with the invention, the facilities for stretching the strip 2 so that the initial center distance between the detectable markings 2*a* thereon is increased to the required distance *d* for registration with the troughs in the heat-sealing station PS is accomplished independently of the advancing mechanism 26 and 27 by a separate stretching station PE disposed upstream of the station PS. The stretching operation itself takes place entirely during the stationary portion of the indexing cycle, i.e., the portion of the cycle between the time that the advancing means 26, 27 has completed the index of a trough through the distance *d* into the welding station and the time of the next indexing movement. Since as a result the advancing mechanism 26, 27 need not apply any stretching or traction force on the strip 2, it can be of relatively inexpensive and lightweight construction.

One suitable arrangement for effecting the novel stretching operation in accordance with the invention is illustrated in more detail in connection with FIGS. 2 and 3. A standard 8 supports the shaft 4*a* upon which the reel 4 for the strip 2 is mounted. The strip 2 extends from the reel 4 around a guide roller 4*g* mounted on an arm 4*h* that is pivotally mounted to the standard 8 at a point 4*i*. From the roller 4*g*, the strip 2 extends around roller 4*f* and into the stretching station PE. Specifically, the portion of the strip 2 having the initial spacing P between successive detectable markings 2*a* thereon is routed through a preforming section including a punch 16 and a cooperating die 11*a*, and is thereafter routed around guide rollers 4*e*, 4*d*, 4*f*, and 4*c* in succession as shown, and then into the welding station PS which may physically be disposed in vertical alignment with the standard 8 as shown.

Intermediate the rollers 4*d* and 4*f* is a suitable detector of the markings 2*a*, 2*a* on the strip 2. Illustratively, if the markings 2*a* consist of perforations or other suitable means for selectively passing light through the strip 2, the detector may consist of a photocell assembly 14. If desired, the markings 2*a* may be detected by magnetic or other equivalent means, in which case the detector will be suitably configured.

The position of the photocell 14 is made adjustable in the direction of advance of the strip 2 to provide precise alignment of a marking 2*a* with the photocell at the conclusion of a cycle of advance of the strips 1 and 2. For this purpose, the photocell 14 may be attached to a support member 14*a*, which has a threaded aperture therethrough (not shown), adapted to be traversed in lead-screw fashion by a threaded rod 12 which is rotatably mounted between spaced upstanding portions 11, 11 of the die section 11*a*. The angular position of the rod 12, and thereby the linear position of the support 14*a* and the photocell 14, may be manually adjusted by turning a knurled knob 12*a* until the photocell 14 is accurately aligned with the adjacent mark 2*a*. Once such position is obtained, the position of the rod 12 can be secured by means of a lock nut 13.

Figure 2:
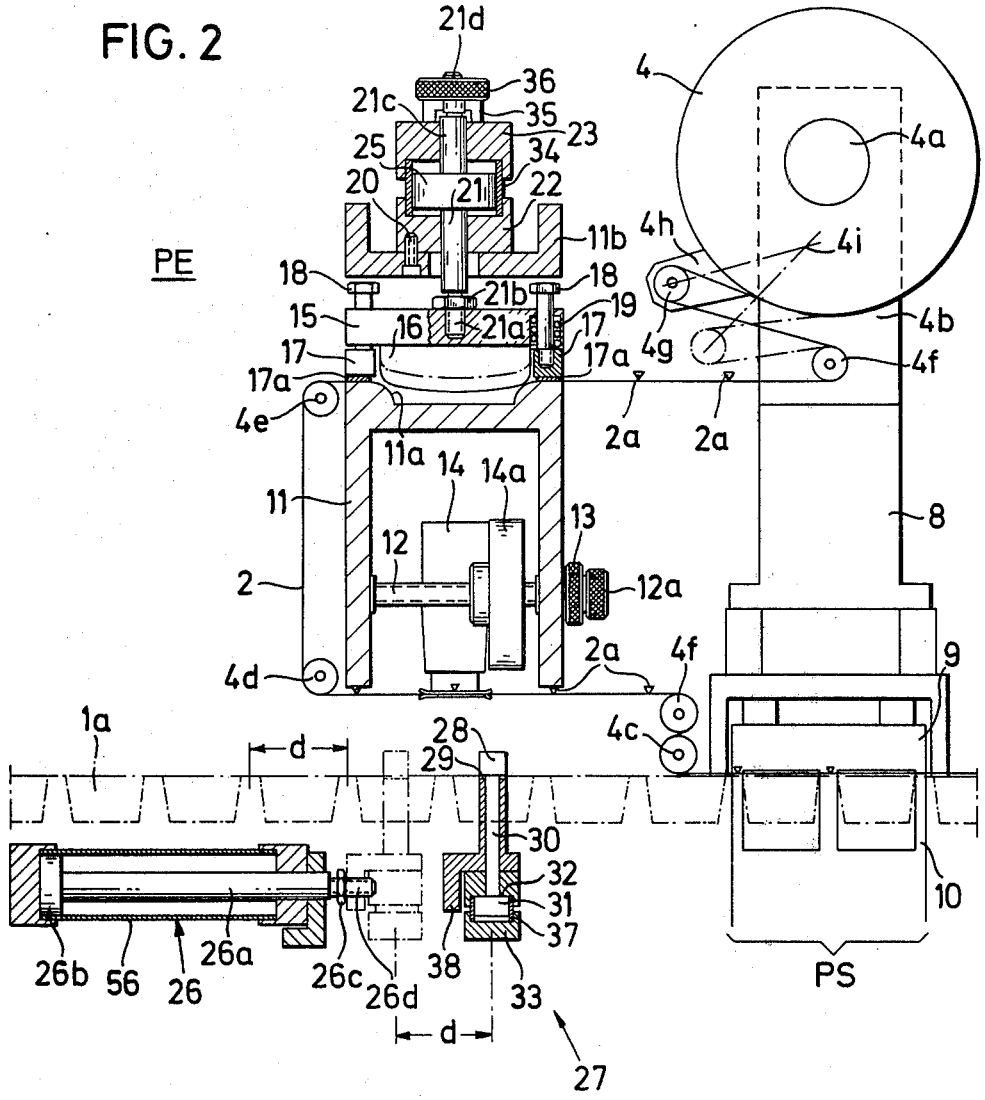
FIG. 2 is a fragmentary elevation view, partly in section, of the lid stretching and registration facilities of FIG. 1.
Figure 3:
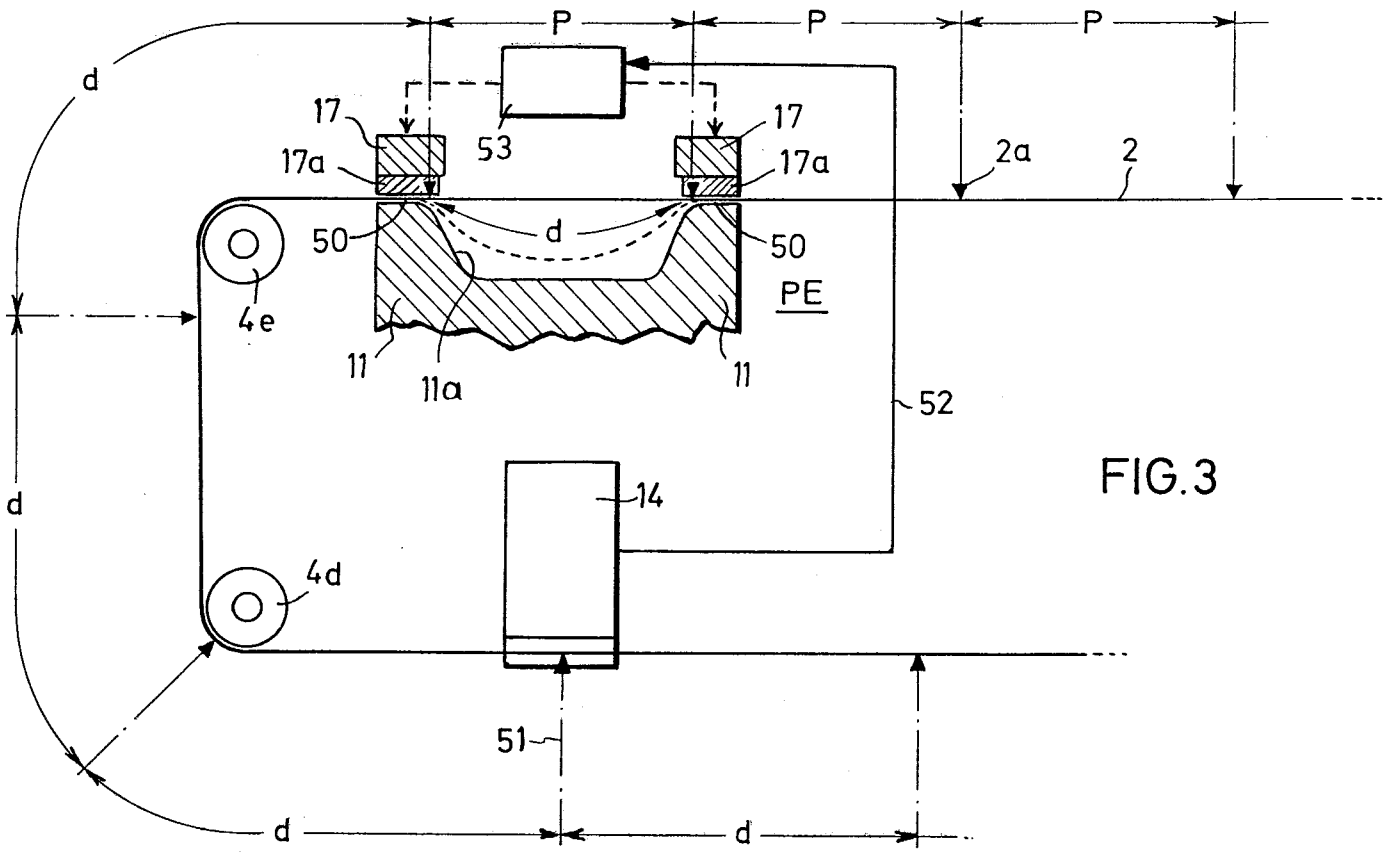
FIG. 3 is a highly stylized representation of a portion of the path of a strip from which the lids of the heat-sealed containers are cut, showing the relationship between the lid-defining detectable markings on the second strip and the various detecting and stretching facilities in accordance with the invention.

Within the stretching station PE itself, the dimension of the die section 11*a* in the direction of advance of the strip 2 is made illustratively equal to the initial distance P between successive markings 2*b*, as shown best in FIG. 3. The longitudinal ends of the die section 11*a* are determined by upper surfaces 50, 50 of the spaced uprights 11. The surfaces 50 cooperate respectively with a pair of vertically movable bars 17, 17 having at their lower ends pads 17*a*, 17*a* having a high coefficient of friction. Upon the alignment of each successive mark 2*a* on the strip 2 with the photocell 14 as indicated above, the bars 17 are actuated toward the mating surfaces 50 to clamp therebetween the ends of the section of the strip 2 of length P, then disposed in the stretching station PE. As soon as the ends of the strip portion are so gripped, the punch 16 (FIG. 2) cooperating with the die section 11*a* is moved transversely downward toward the captured portion of the strip to imprt a permanent elongation to such captured portion of an amount ($d$ - P), whereby the now-deformed section, shown in dotted lines in FIG. 3, exhibits a total length $d$ between spaced ones of the markings 2*a*.

In order to impart the required vertical movement of the punch 16, such punch is affixed to a crosspiece 15, which is secured at both ends to the respective bars 17 by means of bolts 18. A lower threaded end 21*a* of a piston rod 21 is carried in the crosspiece 15, such piston rod 21 extending from a piston 25 which cooperates with a surrounding cylinder 34. The cylinder 34 and the parts contained therein are supported within a member 22 which is affixed by screws 20 to a portion 11*b* suitably secured to the portion 11 of the die section 11*a*.

The length of travel of the punch 16, and thereby the degree of elongation of the captured section of the strip 2, is made variable by means of an adjustment screw 35 which cooperates with an upper end 21*c* of the piston rod 21. Once the desired degree of adjustment of the punch 16 is set, the adjustment screw 35 may be secured by means of a knurled lock nut 21*d*.

The improved arrangement indicated in FIGS. 2 and 3 operates as follows: Initially, the photocell assembly 14 is adjusted in a direction parallel to the path of movement of the underlying strip 2 so that at the end of an indexing movement through the distance $d$ by the advancing assembly 26, 27, one of the markings 2*a* on the strip 2 is in exact alignment with a working axis 51 (FIG. 3) of the photocell 14. As a result, the photocell 14 will be actuated to yield an output pulse on a line 52 only after the strip 2 has come to rest. The output line 52 is coupled to the input of a suitable clamp and punch actuator 53, which initially responds to force the bars 17 downwardly to grip the section of the strip 2 then disposed in the station PE, and to thereafter initiate a downward movement of the punch 16 to elongate such gripped section of the strip 2 from its initial length P to a final length $d$. After such elongation, the bars 17 are released to permit further movement of the strip 2.

Once the calibration operation is completed, the normal feed cycle of the advancing mechanism 26, 27 (FIG. 2) can proceed to index each trough section 1*a* into the heat-sealing station PS and to simultaneously move a corresponding-length section of the strip 2 into such welding station. Since each movement of the strip 2 at the output of the station PE will be through the distance $d$, and since at the conclusion of each such movement a succeeding portion of the strip 2 will be elongated in the station PE to the length $d$, each marking 2*a* on the portion of the strip 2 at the output side of the station PE will come into registration with the photocell 14 precisely at the end of the indexing movement of the advancing means 26, 27. Consequently, the repetitive pattern of (1) the movement of a marking 2*a* of a stretched length of the strip 2 into alignment with the photocell at the end of movement of the strips 1 and 2, (2) the permanent elongation in the section PE of a length of the strip 2 by a value $d$ - P during the stationary portion of the index cycle following such alignment, and (3) the movement of such stretched portion of the strip 2 out of the station PE and into registration with the photocell 14 at the proper time, becomes a self-reinforcing pattern. Moreover, each indexing movement of the portion of the strip 2 on the output side of the station PE through the required distance $d$ will be accompanied by an advance of the portion of the strip 2 on the input side of the stretching station PE only by the distance P. The "slack" distance $d$ - P will be taken up in the stretching station itself. Accordingly, if in an initial operation the length of strip P within the station PE is bounded exactly by two adjacent marks 2*a* as illustrated in FIG. 3, each succeeding indexing operation will cause the appropriate marks 2*a* to be positioned in the same orientation.

Further details of the advancing mechanism 26, 27 are shown in FIG. 2. The ram 26 includes an outer cylinder 56 in which rides a piston 26*b* affixed to a piston rod 26*a*. The rod 26*a* has at its outer end a threaded portion 26*d*, which is cooperable with an internal thread (not shown) on a support member 38 of the bracket 27. The relative positioning of the threaded members 26*d* and 38 determine the pitch of the indexing movement, which as indicated above is selected to be equal to the center distance *d* of the successive troughs. Once the correct indexing distance is set, it may be secured by means of a lock nut 26*c*. The upper end of the support member 38 is associated with a clamping section 28, 29, which is adapted to selectively grip the successive troughs 1*a* on the strip 1. The clamp sections 28, 29 are controlled by movements of a rod 30 affixed to a piston 31 which is slidable within a cylinder 37.

The heat-sealing station PS may include an upper die section 9 supported on the upright 8, and a lower die section 10. The heat-sealing operation is accomplished by bringing the die sections 9 and 10 together at a suitable temperature when a trough section 1*a* and an associated superposed, stretched lip portion of the strip 2, are within the station PS. Such heat-sealing operation, which takes place in the stationary portion of the feed cycle, may be accomplished simultaneously with the permanent elongation of a succeeding section of the strip 2 by the stretching station PE.

In the foregoing, one illustrative arrangement of the invention has been described. Many variations and modifications will now occur to those skilled in the art. It is accordingly desired that the scope of the appended claims not be limited to the specific disclosure herein contained.

I claim:

1. In an apparatus for producing a succession of identical heat-sealed containers, comprising means for indexing into a heat-sealing station a plurality of troughs preformed on a first strip through equal first intervals and for simultaneously indexing a second strip into the station, the troughs being disposed at equal distances corresponding to the first interval, the second strip having disposed thereon detectable markings which are initially disposed therealong at equal second intervals slightly smaller than the first interval, detecting means associated with the path of movement of the second strip for generating a control signal when a marking of the second strip comes into alignment therewith, means for stretching a portion of the second strip by an amount sufficient to increase the spacing between the successive markings on at least the front end of the stretched portion of the second strip to the first interval upon the occurrence of the control signal, whereby the stretched regions between successive markings on the front portion of the second strip define lids which are heat-sealable to the associated troughs, said stretching means including preforming means disposed upstream of the station and responsive to the control signal for initiating an elongation of an intermediate portion of the second strip, corresponding in length to the difference between the first and second intervals, between successive indexing movements, the improvement wherein the preforming means comprises, in combination, first and second clamping means disposed in spaced relation for gripping and immobilizing the ends of the intermediate section of the second strip in response to the control signal, each of the first and second clamping means being disposed upstream of the detecting means, and means independent of the first and second clamping means for imparting a longitudinal deformation to the so-gripped intermediate section of the second strip; and wherein the apparatus further comprises means for positioning the detecting means relative to the second strip for initiating the generation of the control signal at the end of each indexing movement.

2. Apparatus as defined in claim 1, in which the indexing means are disposed along the path of the first strip upstream of the heat-sealing station for selectively engaging the first strip independently of the second strip, and in which the heat-sealing station is adapted to affix the front end of the second strip to the associated trough whereby the indexing of the first strip into the heat-sealing station by the indexing means is effective to simultaneously advance the second strip into such station without the necessity of a separate positive indexing drive for the second strip.

3. Apparatus as defined in claim 1, further comprising means for adjusting the length of movement of the deformation imparting means.

* * * * *